US009899779B1

(12) United States Patent
Lin

(10) Patent No.: US 9,899,779 B1
(45) Date of Patent: Feb. 20, 2018

(54) WATERPROOF ELECTRIC CONNECTOR MODULE

(71) Applicant: ASSEM TECHNOLOGY Co., LTD., New Taipei (TW)

(72) Inventor: I-Hsiu Lin, New Taipei (TW)

(73) Assignee: Assem Technology Co., Ltd., New Taipei (TW)

( * ) Notice: Subject to any disclaimer, the term of this patent is extended or adjusted under 35 U.S.C. 154(b) by 0 days.

(21) Appl. No.: 15/408,697

(22) Filed: Jan. 18, 2017

(51) Int. Cl.

| | |
|---|---|
| ***H01R 24/60*** | (2011.01) |
| ***H01R 13/52*** | (2006.01) |
| ***H01R 13/405*** | (2006.01) |
| ***H01R 13/6581*** | (2011.01) |
| *H01R 107/00* | (2006.01) |

(52) U.S. Cl.
CPC ..... *H01R 24/60* (2013.01); *H01R 13/405* (2013.01); *H01R 13/5202* (2013.01); *H01R 13/5219* (2013.01); *H01R 13/6581* (2013.01); *H01R 2107/00* (2013.01)

(58) Field of Classification Search
CPC .. H01R 24/60; H01R 13/405; H01R 13/5202; H01R 13/5219
USPC ..... 439/271, 585
See application file for complete search history.

(56) References Cited

U.S. PATENT DOCUMENTS 9,627,796 B2 * 4/2017 Tsai ..... H01R 13/5202
9,660,373 B2 * 5/2017 Tsai ..... H01R 13/5202
2016/0079714 A1 * 3/2016 Wu ..... H01R 13/6585 439/607.05
2016/0093974 A1 * 3/2016 Lai ..... H01R 13/5202 439/736
2016/0093994 A1 * 3/2016 Chen ..... H01R 12/724 439/607.01
2016/0181722 A1 * 6/2016 Tsai ..... H01R 13/5202 439/587
2016/0181723 A1 * 6/2016 Tsai ..... H01R 13/5202 439/587
2016/0261056 A1 * 9/2016 Jiang ..... H01R 13/6585
2016/0268722 A1 * 9/2016 Tsai ..... H01R 13/5202
2016/0329667 A1 * 11/2016 Tsai ..... H01R 24/70
2017/0125944 A1 * 5/2017 Yokoyama ..... H01R 13/502
(Continued)

*Primary Examiner* — Alexander Gilman
(74) *Attorney, Agent, or Firm* — Muncy, Geissler, Olds & Lowe, P.C.

(57) ABSTRACT

A waterproof electric connector module includes an electrically insulative housing defining an accommodation chamber, a front slot and a rear open chamber, a metal shielding cover covered the top side of the electrically insulative housing and having grounding pins inserted into the electrically insulative housing, an electric connector including an electrically insulative terminal block in the accommodation chamber, a tongue plate extended from the electrically insulative terminal block, grounding terminals mounted at two opposite lateral sides of the electrically insulative terminal block and electrically connected with the grounding pins of the metal shielding cover and a conducting terminal set mounted in the electrically insulative terminal block with conducting terminal contact portions respectively arranged on opposing top and bottom walls of the tongue plate and conducting terminal bonding portions extended out of the electrically insulative terminal block and the rear open chamber, and a waterproof adhesive sealed the rear open chamber.

5 Claims, 8 Drawing Sheets

(56) References Cited

U.S. PATENT DOCUMENTS

| | | | | |
|---|---|---|---|---|
| 2017/0133795 | A1* | 5/2017 | Guo | H01R 13/6581 |
| 2017/0149165 | A1* | 5/2017 | Tsai | H01R 13/52 |
| 2017/0155216 | A1* | 6/2017 | Yao | H01R 12/722 |
| 2017/0162975 | A1* | 6/2017 | Tsai | H01R 13/5202 |
| 2017/0179634 | A1* | 6/2017 | Du | H01R 13/521 |

* cited by examiner

WATERPROOF ELECTRIC CONNECTOR MODULE

BACKGROUND OF THE INVENTION

1. Field of the Invention

The present invention relates to electric connector technology and more particularly, to a waterproof electric connector module, which includes an electrically insulative housing, an electric connector mounted in the electrically insulative housing with conducting terminal contact portions thereof extended out of a rear open chamber of the electrically insulative housing, a metal shielding cover covering a top side of a body of the electrically insulative housing, and a waterproof adhesive sealed in the rear open chamber to achieve excellent waterproofing.

2. Description of the Related Art

With the progress of electronic technology, many electronic and electrical products have been continuously created, bringing comfort and convenience to people's works and lives but also leading to our increased reliance on electronic and electrical products. Through a variety of electronic signal applications, we can operate and control a variety of electronic and electrical products. With continuous improvement in electronic and electrical product production, the functions of electronic and electrical products have also been greatly improved. Subject to improvements on electronic signal applications and creation of advanced electric connectors and signal transmission interfaces, electronic signal transmission speed has been significantly enhanced. There are known various electronic signal transmission interfaces and electric connectors of different kinds and sizes for different applications. An advanced electronic product has installed therein various different electronic signal transmission interfaces and electric connectors to satisfy different signal transmission requirements. In consequence, advanced electronic products must provide sufficient installation space for the installation of various different electronic signal transmission interfaces and electric connectors.

An electric connector generally comprises an electrically insulative core member, a plurality of conducting terminals inserted through the electrically insulative core member, and a metal shielding shell surrounding the electrically insulative core member. The metal shielding shell is a metal sheet member stamped into shape and wrapped about the electrically insulative core member. After the metal shielding shell is wrapped about the electrically insulative core member, gaps are left around the border edges of the metal shielding shell. In the application of the electric connector, external moisture can permeate through the gaps around the border edges of the metal shielding shell into the circuit board to which the conducting terminals are bonded, causing a short circuit, circuit board damage or component burnt out.

Therefore, how to solve the problem of moisture permeation in the outer metal shell of an electric connector that can result in a short circuit in the circuit board or circuit board failure is the direction of improvement this industry-related manufacturers need to go to.

SUMMARY OF THE INVENTION

The present invention has been accomplished under the circumstances in view. It is therefore the main object of the present invention to provide a waterproof electric connector module, which has a gasket ring mounted on a front side thereof and a waterproof adhesive sealed in rear open chamber thereof to achieve excellent waterproofing.

To achieve this and other objects of the present invention, a waterproof electric connector module comprises an electrically insulative housing, a metal shielding cover, an electric connector, and a waterproof adhesive. The electrically insulative housing comprises a body, an accommodation chamber defined in the body, a front slot located in a front side of the body and disposed in communication with the accommodation chamber, an oval-shaped hollow flange protruded from a front wall of the body and defining a mounting portion on the periphery thereof, a rear open chamber vertically disposed rear side of the body, a top opening located in a top side of the rear open chamber, a plurality of plug holes symmetrically disposed in the body at two opposite lateral sides of the top opening, a plurality of through holes cut through a back wall of the body and disposed in communication with the rear open chamber, and a gasket ring mounted on the mounting portion. The metal shielding cover is mounted on the top side of the electrically insulative housing, comprising a plurality of grounding pins respectively inserted into the plug holes of the electrically insulative housing. The electric connector is mounted in the accommodation chamber of the electrically insulative housing, comprising an electrically insulative terminal block, a conducting terminal set mounted in the electrically insulative terminal block, a tongue plate forwardly extended from a front side of the electrically insulative terminal block and inserted through the front slot of the electrically insulative housing, and a plurality of grounding terminals respectively mounted at two opposite lateral sides of the electrically insulative terminal block and respectively electrically connected with the grounding pins of the metal shielding cover. The conducting terminal set comprises a plurality of conducting terminal contact portions located at a front side thereof and respectively positioned in opposing top and bottom walls of the tongue plate, and a plurality of conducting terminal bonding portions located at an opposing rear side thereof and extended out of the rear open chamber of the electrically insulative terminal block. The waterproof adhesive seals up the rear open chamber of the electrically insulative housing. Further, a back cover sheet is detachably attached to the body of the electrically insulative housing to cover the through holes. Further, the back cover sheet can be a Mylar film, plastic film or silicone film.

Further, the electrically insulative housing is molded on the electric connector using insert molding technology, enabling the metal shielding shell, the tongue plate and the conducting terminal contact portions of the conducting terminal set to be partially extended out of the front slot of the electrically insulative housing. The electric connector further comprises a metal shielding shell surrounding the electrically insulative terminal block and the tongue plate and defining therein an insertion chamber. Thus, the insertion chamber of the metal shielding shell, the tongue plate and the conducting terminal contact portions of the conducting terminal set constituting a plug-in unit conforming to the Universal Serial Bus (USB Type-C) specification.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
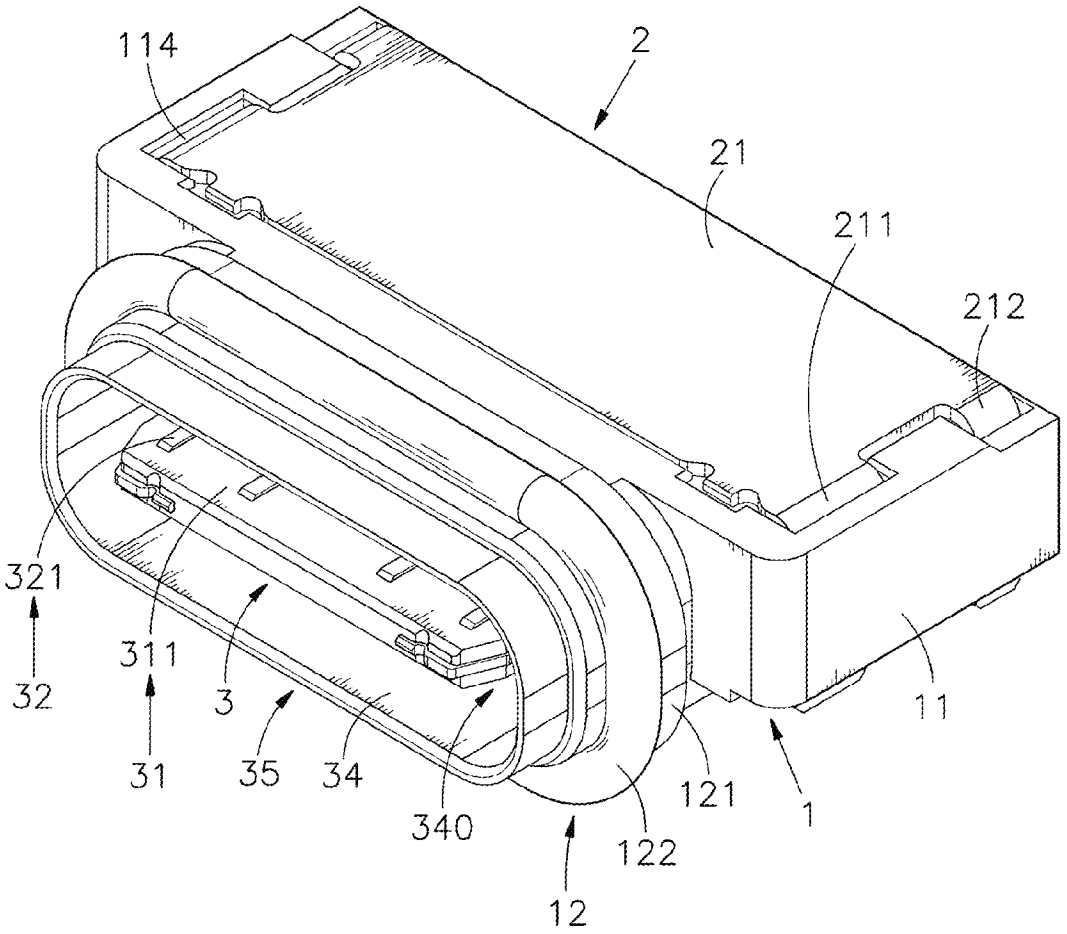
FIG. 1 is an oblique front elevational view of a waterproof electric connector module in accordance with the present invention.
Figure 2:
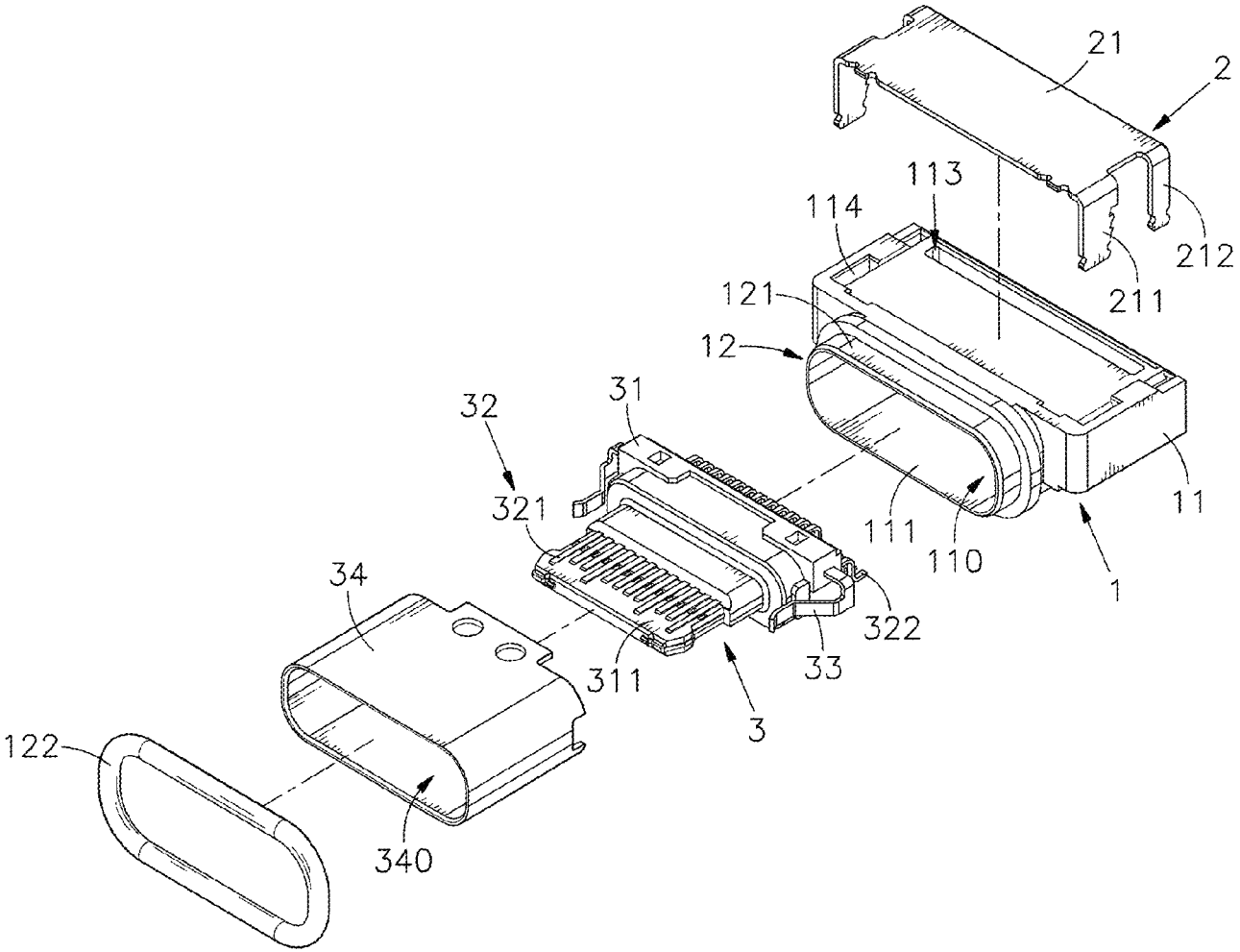
FIG. 2 is an exploded view of the waterproof electric connector module in accordance with the present invention.
Figure 3:
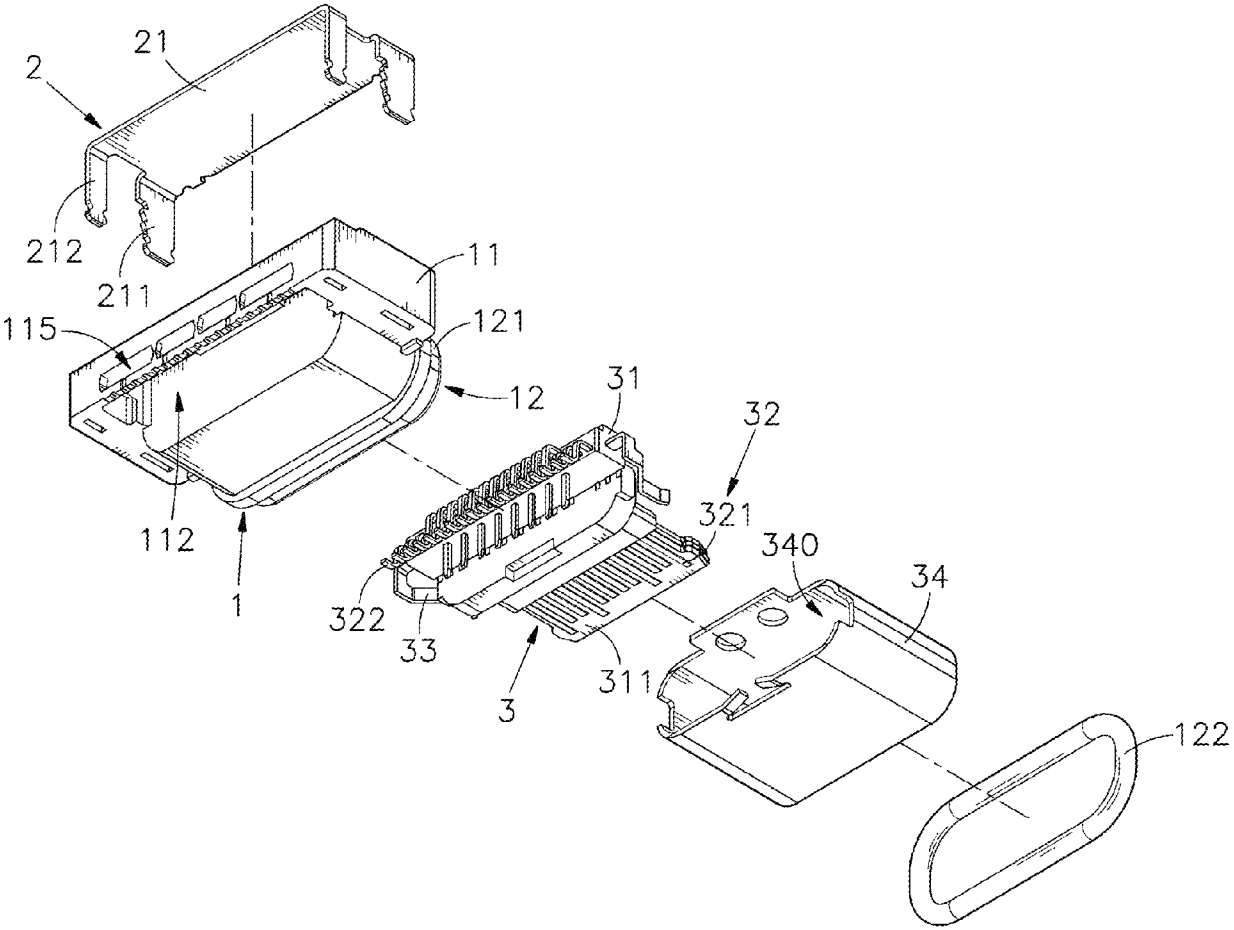
FIG. 3 is another exploded view of the waterproof electric connector module in accordance with the present invention when viewed from another angle.
Figure 4:
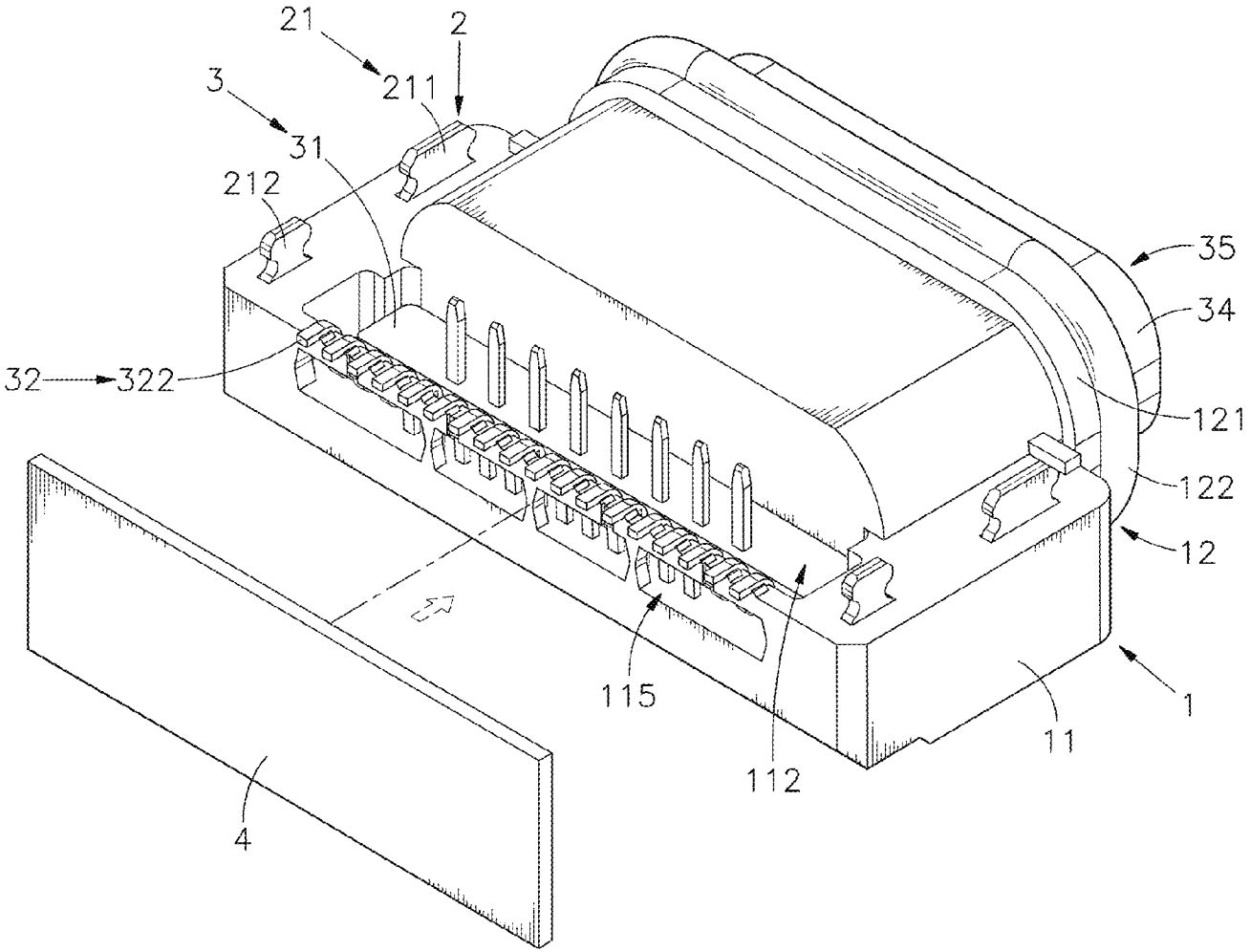
FIG. 4 is an oblique rear elevational view of the waterproof electric connector module in accordance with the present invention before sealing of the rear open chamber of the electrically insulative housing with the waterproof adhesive.
Figure 5:
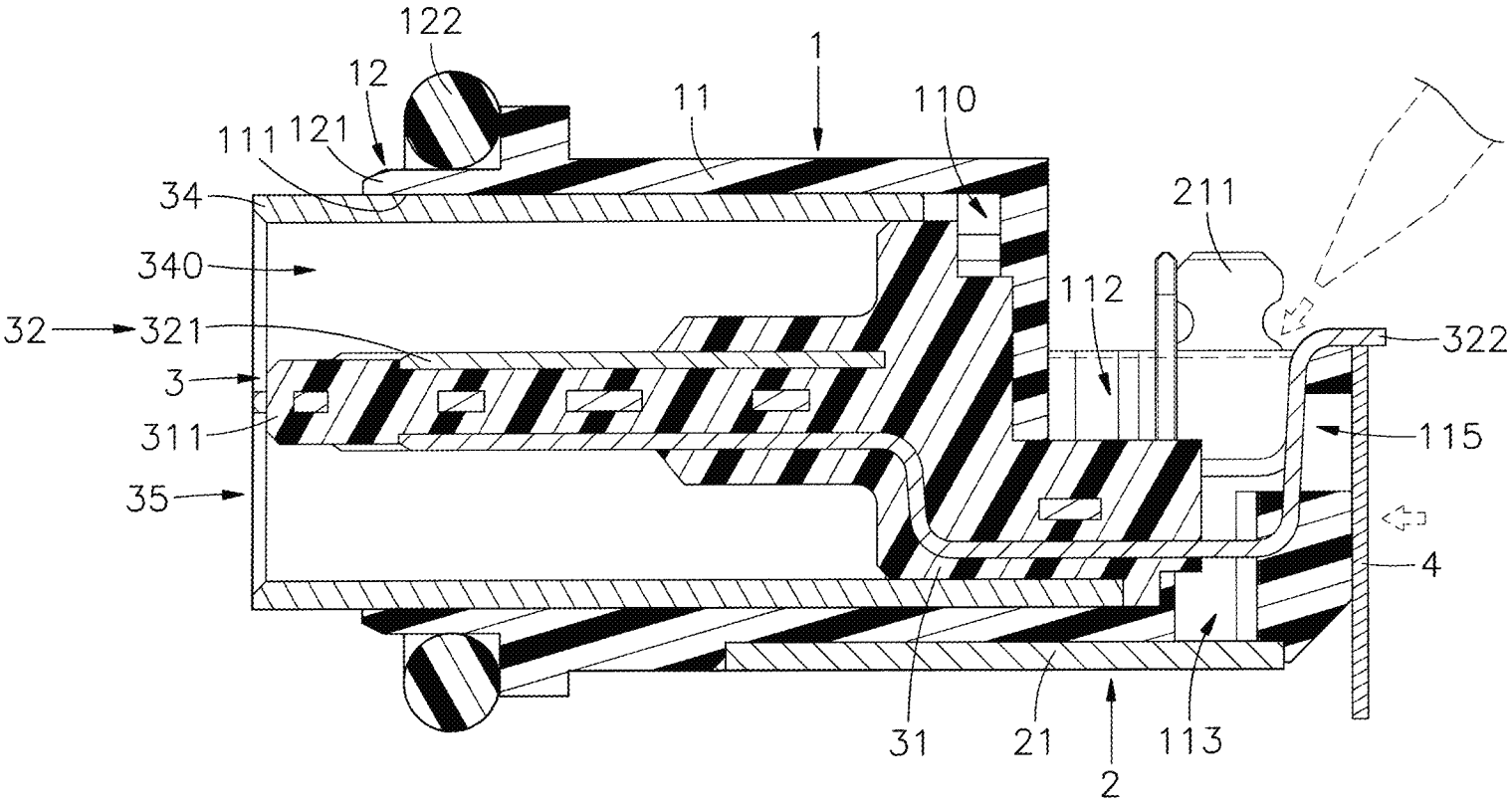
FIG. 5 is a schematic sectional side view of the present invention during the waterproof adhesive filling operation.
Figure 6:
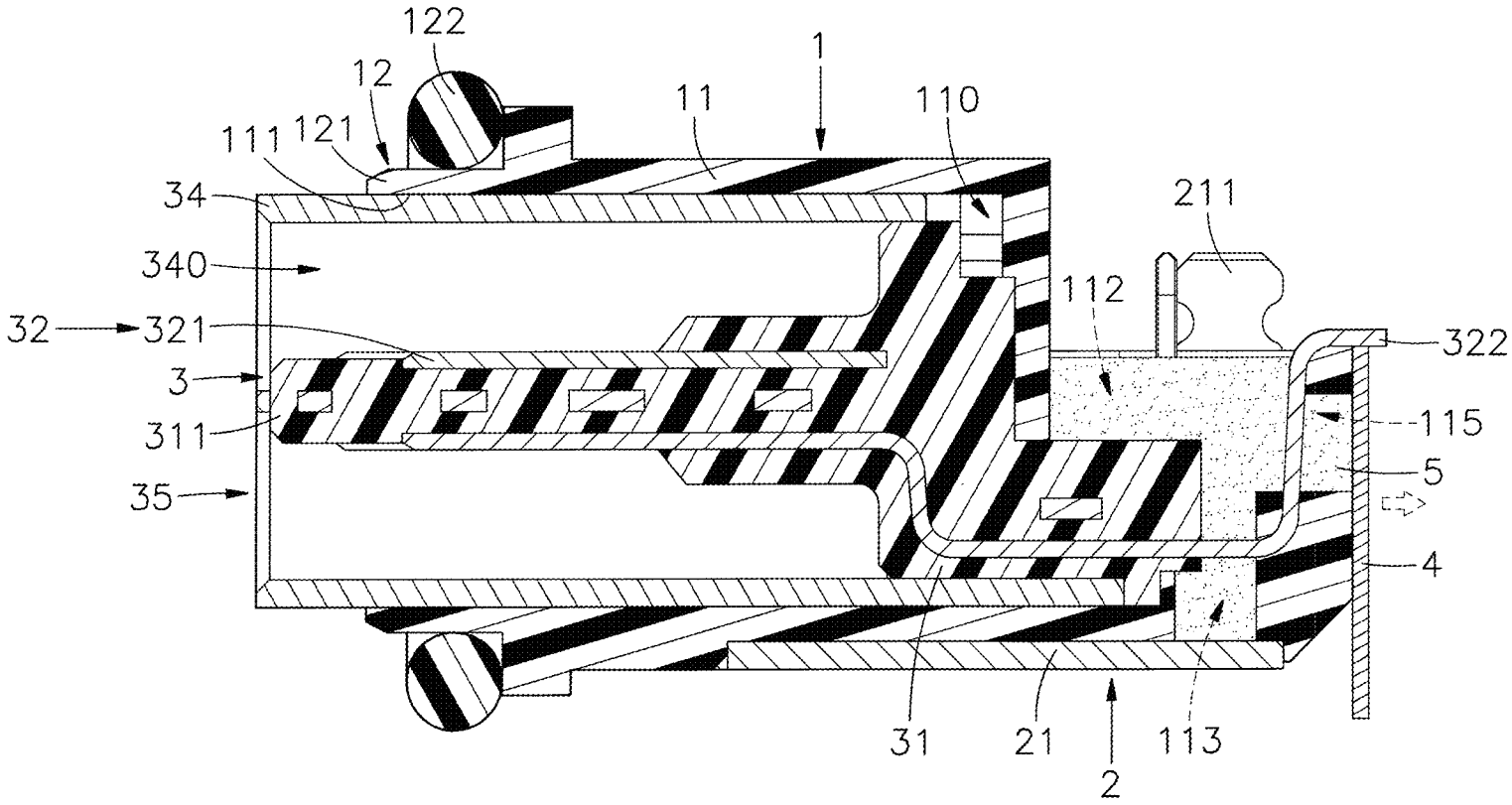
FIG. 6 is a schematic sectional side view of the present invention illustrating the rear open chamber the electrically insulative housing filled up with the waterproof adhesive.
Figure 7:
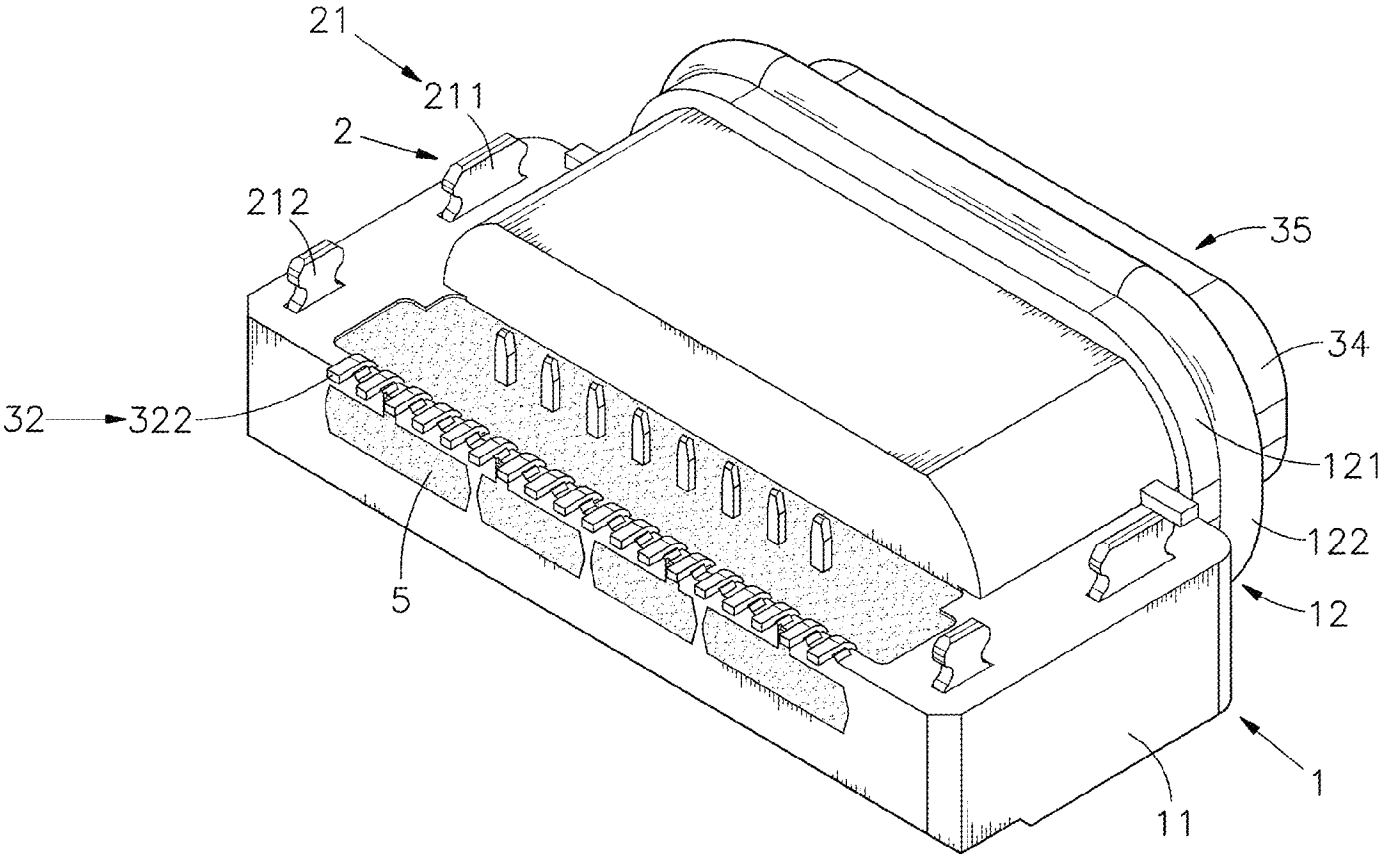
FIG. 7 is an oblique rear elevational view of the waterproof electric connector module in accordance with the present invention after sealing of the rear open chamber of the electrically insulative housing with the waterproof adhesive.

Referring to FIGS. 1-3, a waterproof electric connector module in accordance with the present invention is shown. The waterproof electric connector module comprises an electrically insulative housing 1, a metal shielding cover 2 and an electric connector 3.

The electrically insulative housing 1 comprises a body 11, an oval-shaped hollow flange 12 protruded from a front wall of the body 11, an accommodation chamber 110 defined in the body 11, a front slot 111 cut through the front wall of the body 11 within the oval-shaped hollow flange 12 and disposed in communication with the accommodation chamber 110, a vertically extended rear open chamber 112 defined near a rear side of the body 11 outside the accommodation chamber 110, a top opening 113 located in a top side of the rear open chamber 112 in communication with the accommodation chamber 110, a plurality of plug holes 114 symmetrically disposed at two opposite lateral sides of the top opening 113, and a plurality of through holes 115 cut through a back wall of the body 11 and disposed in communication with the rear open chamber 112. Further, the oval-shaped hollow flange 12 defines a mounting portion 121 for the mounting of a gasket ring 122.

The metal shielding cover 2 comprises a flat metal shell body 21, and a plurality of grounding pins 211 and positioning pins 212 respectively and perpendicularly extended from two opposite lateral sides of the flat metal shell body 21.

The electric connector 3 comprises an electrically insulative terminal block 31, a conducting terminal set 32 integrally mounted in the electrically insulative terminal block 31, a plurality of grounding terminals 33 mounted at two opposite lateral sides of the electrically insulative terminal block 31, a tongue plate 311 forwardly extended from a front side of the electrically insulative terminal block 31, and a metal shielding shell 34 surrounding the electrically insulative terminal block 31 and the tongue plate 311. The conducting terminal set 32 has conducting terminal contact portions 321 thereof respectively extended out of the front side of the electrically insulative terminal block 31 and respectively attached to opposing top and bottom walls of the tongue plate 311, and opposing conducting terminal bonding portions 322 thereof respectively extended out of opposing rear side of the electrically insulative terminal block 31. The metal shielding shell 34 defines therein an insertion chamber 340 that accommodates the electrically insulative terminal block 31 and the tongue plate 311. Thus, the insertion chamber 340 of the metal shielding shell 34, the tongue plate 311 and the conducting terminal contact portions 321 of the conducting terminal set 32 constitute a plug-in unit 35 conforming to the Universal Serial Bus (USB Type-C) specification.

When assembling the waterproof electric connector, attach the metal shielding cover 2 to the top side of the body 11 of the electrically insulative housing 1 to force the grounding pins 211 and the positioning pins 212 into the respective plug holes 114 of the body 11, and then mount the electrically insulative terminal block 31, tongue plate 311, conducting terminal set 32, grounding terminals 33 and metal shielding shell 34 of the electric connector 3 in the accommodation chamber 110 of the body 11, enabling the plug-in unit 35 to be extended out of the accommodation chamber 110 and suspended in the front slot 111 and the conducting terminal bonding portions 322 of the conducting terminal set 32 of the electric connector 3 to be extended out of the accommodation chamber 110 and suspended in the rear open chamber 112. At this time, the grounding terminals 33 of the conducting terminal set 32 of the electric connector 3 are respectively disposed in contact with the respective grounding pins 211 of the metal shielding cover 2. Thus, the electrically insulative housing 1, the metal shielding cover 2 and the electric connector 3 are assembled to form an electric connector module. In the present preferred embodiment, the electrically insulative housing 1 is molded on the electric connector 3 using insert molding technology.

Referring to FIGS. 4-7 and FIGS. 2 and 3 again, after mounting the electric connector 3 in the electrically insulative housing 1 and covering the metal shielding cover 2 over the electrically insulative housing 1 to top opening 113 with the flat metal shell body 21, fasten a back cover sheet 4 to the back wall of the body 11 to block the through holes 115, and then fill up the rear open chamber 112 with a waterproof adhesive 5 to seal up the rear open chamber 112, enabling the front slot 111 in the oval-shaped hollow flange 12, the tongue plate 311 of the electrically insulative terminal block 31 and the conducting terminal contact portions 321 of the conducting terminal set 32 of the electric connector 3 to be isolated from the rear open chamber 112 of the body 11. After the waterproof adhesive 5 in the rear open chamber 112 is coagulated, remove the back cover sheet 4 from the through holes 115 of the body 11. Thus, the rear open chamber 112 of the body 11 of the electrically insulative housing 1 and the area around the oval-shaped hollow flange 12 are well sealed against water permeation.

Figure 8:
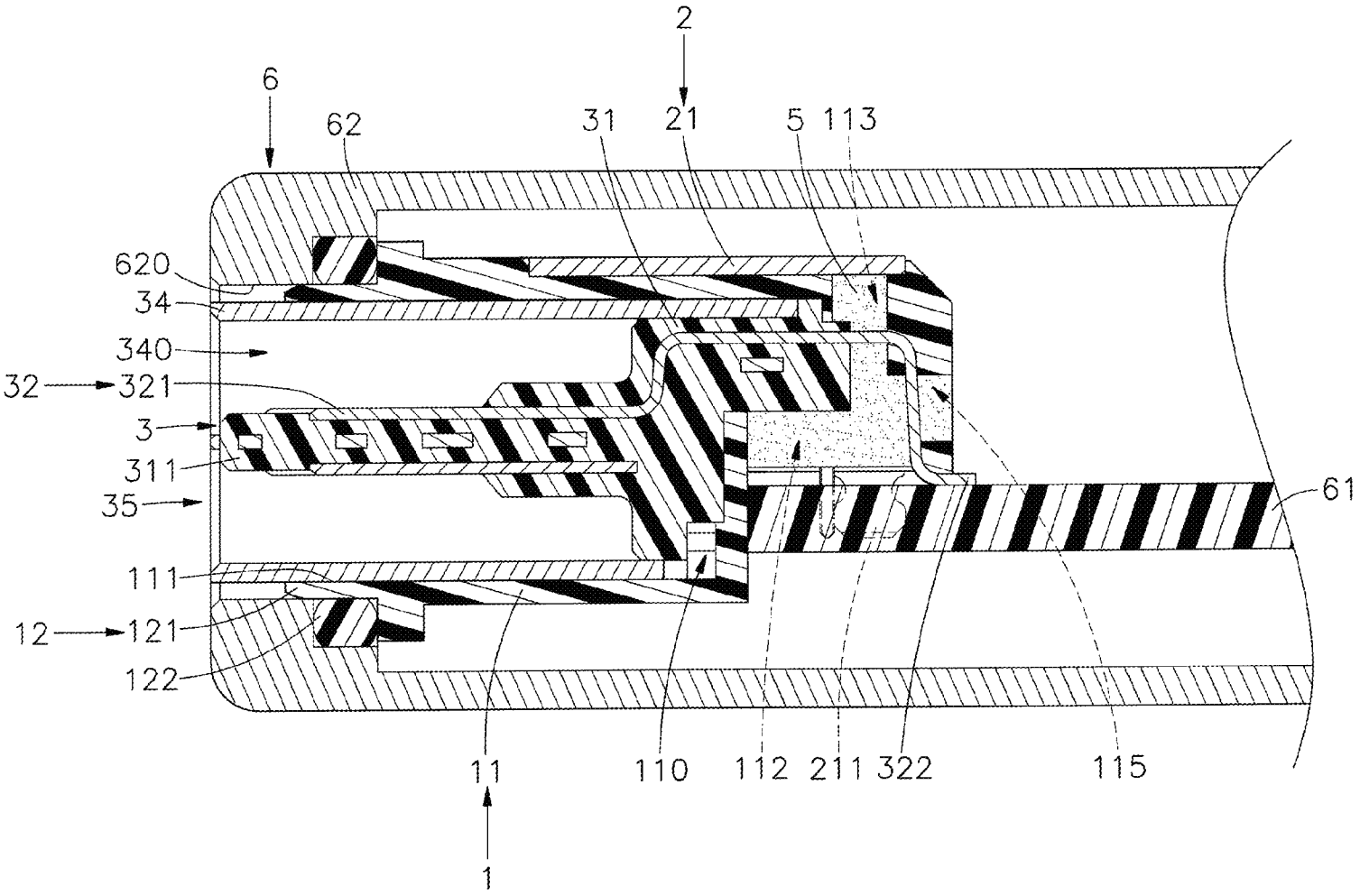
FIG. 8 is a sectional side view of the present invention, illustrating the waterproof electric connector module installed in an electronic product.

Referring to FIG. 8 and FIGS. 2, 3, 6 and 7 again, when using the waterproof electric connector module in an electronic product 6, bond the conducting terminal bonding portions 322 of the conducting terminal set 32 to a circuit board 61 of the electronic product 6 to electrically connect the electric connector 3 to the circuit board 61, enabling the electric connector module to be positioned in a mounting hole 620 in a housing 62 of the electronic product 6 with the gasket ring 122 which is around the mounting portion 121 of the oval-shaped hollow flange 12 of the electrically insulative housing 1 and is tightly abutted against an inside wall of the housing 62 of the electronic product 6 in the mounting hole 620 to seal the gap and the plug-in unit 35 of the electric connector 3 exposed to the outside of the housing 62 of the electronic product 6 for the connection of an external mating electric connector. After installation, the gasket ring 122 stops external moisture from passing through the mounting hole 620 of the housing 62 of the electronic product 6 through the area around the metal shielding shell 34 of the electric connector 3 and the front slot 111 in the oval-shaped hollow flange 12 into the accommodation chamber 110 in the body 11; the waterproof adhesive 5 stops external moisture from passing through the rear open chamber 112 into the accommodation chamber 110, i.e., the conducting terminal bonding portions 322 of the conducting terminal set 32 and the circuit board 61 of the electronic product 6 are well sealed against moisture, avoiding damp problems. Thus, subject to the arrangement of the gasket ring 122 around the oval-shaped hollow flange 12 of the electrically insulative housing 1 of the electric connector module and the filling of the waterproof adhesive 5 in the rear open chamber 112 of the body 11, the electric connector module provides excellent waterproof protection.

Further, the aforesaid back cover sheet 4 can be a Mylar film, plastic film or silicone film or any other strippable thin film.

As stated above, the metal shielding cover 2 of the waterproof electric connector module is covered on the top side of the body 11 of the electrically insulative housing 1; the electric connector 3 is mounted in the accommodation chamber 110 of the body 11; the conducting terminal set 32 of the electric connector 3 has the conducting terminal contact portions 321 thereof respectively arranged on the opposing top and bottom walls of the tongue plate 311 and the conducting terminal bonding portions 322 thereof extended out of the rear open chamber 112; the insertion chamber 340 of the metal shielding shell 34, the tongue plate 311 and the conducting terminal contact portions 321 of the conducting terminal set 32 constitute the plug-in unit 35 that extends out of the front slot 111 of the oval-shaped hollow flange 12; the gasket ring 122 is mounted on the mounting portion 121 of the oval-shaped hollow flange 12; the waterproof adhesive 5 fills up the rear open chamber 112. Thus, the gasket ring 122 and the waterproof adhesive 5 provide the area around the oval-shaped hollow flange 12 of the electrically insulative housing 1 and the rear open chamber 112 with a waterproof function. Further, the metal shielding cover 2 shields the top opening 113 of the rear open chamber 112 of the electrically insulative housing 1. Further, the back cover sheet 4 is attached to the body 11 to block the through holes 115 when filling the waterproof adhesive 5 in the rear open chamber 112, avoiding overflow of the waterproof adhesive 5 and enabling the rear open chamber 112 to be well sealed.

In conclusion, the invention provides a waterproof electric connector module, which comprises an electrically insulative housing that comprises an accommodation chamber, a rear open chamber and an oval-shaped hollow flange, a metal shielding cover covered on the top side of the electrically insulative housing, an electric connector mounted in the accommodation chamber with a plug-in unit thereof extended out of the oval-shaped hollow flange and the conducting terminal bonding portions of the conducting terminal set thereof extended out of the rear open chamber, a gasket ring mounted on the oval-shaped hollow flange, and a waterproof adhesive filled up the rear open chamber. Thus, the electric connector module achieves good waterproofing effect. The waterproof electric connector module enables the area around the plug-in unit and the area around the conducting terminal bonding portions of the conducting terminal set to be well protected against moisture permeation, preventing moisture damage to the bonded circuit board.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A waterproof electric connector module, comprising:

an electrically insulative housing comprising an accommodation chamber, a front slot located in a front side thereof and disposed in communication with said accommodation chamber and a rear open chamber vertically located in an opposing rear side thereof;

a metal shielding cover mounted on a top side of said electrically insulative housing, said metal shielding cover comprising a plurality of grounding pins and positioning pins respectively disposed at two opposite lateral sides thereof and inserted into the inside of said electrically insulative housing;

an electric connector mounted in said accommodation chamber of said electrically insulative housing, said electric connector comprising an electrically insulative terminal block, a conducting terminal set mounted in said electrically insulative terminal block, a tongue plate forwardly extended from a front side of said electrically insulative terminal block and inserted through said front slot of said electrically insulative housing and a plurality of grounding terminals respectively mounted at two opposite lateral sides of said electrically insulative terminal block and respectively electrically connected with said grounding pins of said metal shielding cover, said conducting terminal set comprising a plurality of conducting terminal contact portions located at a front side thereof and respectively positioned in opposing top and bottom walls of said tongue plate and a plurality of conducting terminal bonding portions located at an opposing rear side thereof and extended out of said rear open chamber of said electrically insulative terminal block; and a waterproof adhesive sealed up said rear open chamber of said electrically insulative housing.

2. The waterproof electric connector module as claimed in claim 1, wherein said electrically insulative housing comprises a body, an oval-shaped hollow flange protruded from a front wall of said body and defining a mounting portion on the periphery thereof, and a gasket ring mounted on said mounting portion; said accommodation chamber is defined in said body of said electrically insulative housing; said front slot is cut through the said front wall of said body within said oval-shaped hollow flange.

3. The waterproof electric connector module as claimed in claim 2, wherein said electrically insulative housing further comprises a top opening located in a top side of said rear open chamber and covered by said metal shielding cover, a plurality of plug holes symmetrically disposed at two opposite lateral sides of said top opening for receiving said grounding pins of said metal shielding cover, and a plurality of through holes cut through a back wall of said body and disposed in communication with said rear open chamber, and a back cover sheet detachably attached to said body to cover said through holes, said back cover sheet being selected from the group consisting of Mylar film, plastic film and silicone film.

4. The waterproof electric connector module as claimed in claim 1, wherein said electric connector further comprises a metal shielding shell surrounding said electrically insulative terminal block and said tongue plate and defining therein an insertion chamber; said insertion chamber of said metal shielding shell, said tongue plate and said conducting terminal contact portions of said conducting terminal set constituting a plug-in unit conforming to the Universal Serial Bus (USB Type-C) specification.

5. The waterproof electric connector module as claimed in claim 4, wherein said electrically insulative housing is molded on said electric connector using insert molding technology, enabling said metal shielding shell, said tongue plate and said conducting terminal contact portions of said conducting terminal set to be partially extended out of said front slot of said electrically insulative housing.

* * * * *